US010301085B2

(12) United States Patent
Duquet et al.

(10) Patent No.: US 10,301,085 B2
(45) Date of Patent: May 28, 2019

(54) FLUID PRODUCT DISPENSER

(71) Applicant: APTAR FRANCE SAS, Le Neubourg (FR)

(72) Inventors: Frederic Duquet, Crespieres (FR); Stephane Daviot, Graveron Semerville (FR)

(73) Assignee: APTAR FRANCE SAS, Le Neubourg (FR)

( * ) Notice: Subject to any disclaimer, the term of this patent is extended or adjusted under 35 U.S.C. 154(b) by 143 days.

(21) Appl. No.: 15/323,460

(22) PCT Filed: Jul. 2, 2015

(86) PCT No.: PCT/FR2015/051834
§ 371 (c)(1),
(2) Date: Jan. 3, 2017

(87) PCT Pub. No.: WO2016/001596
PCT Pub. Date: Jan. 7, 2016

(65) Prior Publication Data

US 2017/0144812 A1 May 25, 2017

(30) Foreign Application Priority Data

Jul. 4, 2014 (FR) ..... 14 56478

(51) Int. Cl.
*B43K 5/02* (2006.01)
*B65D 47/42* (2006.01)
(Continued)

(52) U.S. Cl.
CPC ..... *B65D 47/42* (2013.01); *A45D 34/045* (2013.01); *B05B 11/3001* (2013.01);
(Continued)

(58) Field of Classification Search
CPC ..... A45D 34/045; A45D 2200/1018; A45D 2200/056
(Continued)

(56) References Cited

U.S. PATENT DOCUMENTS 2,311,367 A 2/1943 Chambers
6,305,863 B1 * 10/2001 Gueret ..... A45D 34/045 401/126
(Continued)

FOREIGN PATENT DOCUMENTS

EP 1 201 558 A1 5/2002
FR 2 924 696 A1 6/2009
FR 2 981 553 A1 4/2013

OTHER PUBLICATIONS

International Preliminary Report on Patentability dated Jan. 19, 2017, issued by the International Bureau in corresponding International Application No. PCT/FR2015/051834.
(Continued)

*Primary Examiner* — Jennifer C Chiang
(74) *Attorney, Agent, or Firm* — Sughrue Mion, PLLC

(57) ABSTRACT

A fluid dispenser comprising a fluid reservoir (1), a pump (2) that is mounted on the fluid reservoir (1), and a pushbutton that is mounted on the pump (2) so as to actuate it;

the fluid dispenser being characterized in that the pushbutton comprises a base (3) that is mounted in stationary manner on the pump (2), and a grip member (4) that is mounted in removable manner on the base (3), the grip member (4) including a fluid applicator (47), the grip member (4) defining a bearing surface (S) which may be pressed axially so as to move the base (3) and thus actuate the pump (2) so as to load the applicator (47) with fluid.

32 Claims, 2 Drawing Sheets

(51) Int. Cl.
*A45D 34/04* (2006.01)
*B05B 11/00* (2006.01)

(52) U.S. Cl.
CPC .... *B05B 11/3052* (2013.01); *A45D 2200/055* (2013.01); *A45D 2200/056* (2013.01); *A45D 2200/1018* (2013.01); *B05B 11/00416* (2018.08); *B05B 11/3074* (2013.01)

(58) Field of Classification Search
USPC ..... 401/188 R
See application file for complete search history.

(56) References Cited

U.S. PATENT DOCUMENTS

| | | | | |
|---|---|---|---|---|
| 6,309,124 | B1 * | 10/2001 | Gueret | A45D 34/045 401/123 |
| 6,634,821 | B2 * | 10/2003 | Gueret | A45D 34/045 401/126 |
| 6,776,549 | B2 * | 8/2004 | Gueret | A45D 34/042 401/126 |
| 6,942,412 | B2 * | 9/2005 | Gueret | A45D 34/045 401/123 |
| 7,377,296 | B2 * | 5/2008 | Gueret | A45D 34/042 141/113 |
| 8,757,914 | B1 * | 6/2014 | Megaro | A45D 34/041 401/218 |
| 2018/0042363 | A1 * | 2/2018 | Kim | A45D 34/045 |

OTHER PUBLICATIONS

International Search Report of PCT/FR2015/051834, dated Oct. 15, 2015. [PCT/ISA/210].

* cited by examiner

Fig. 3A
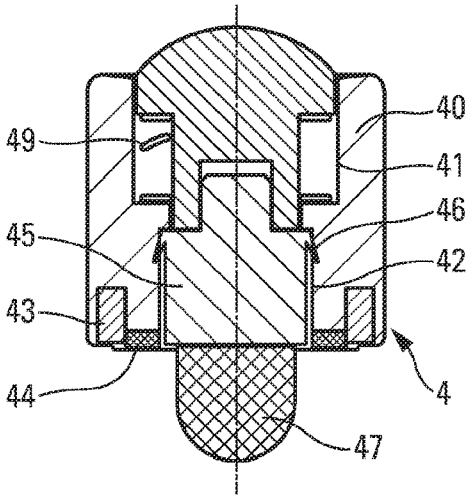
Fig. 3a
Fig. 3B
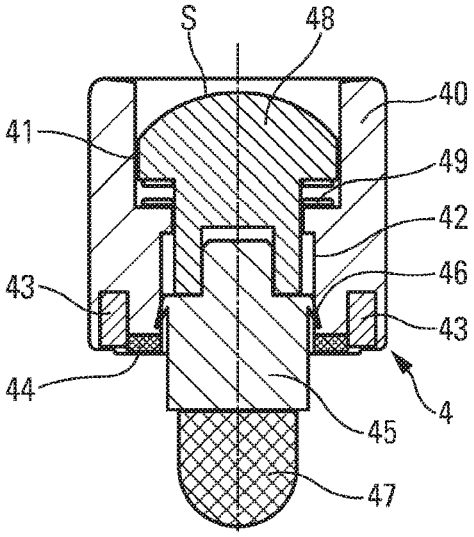
Fig. 3b
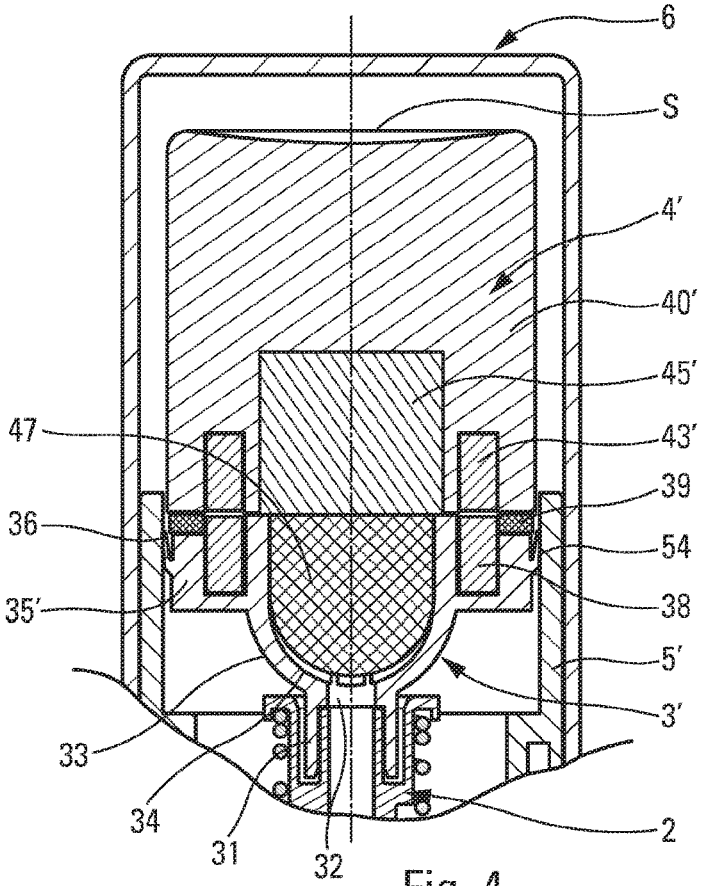
Fig. 4

FLUID PRODUCT DISPENSER

CROSS REFERENCE TO RELATED APPLICATIONS

This application is a National Stage of International Application No. PCT/FR2015/051834 filed Jul. 2, 2015, claiming priority based on French Patent Application No. 1456478, filed Jul. 4, 2014, the contents of all of which are incorporated herein by reference in their entirety.

BACKGROUND OF THE INVENTION

The present invention relates to a fluid dispenser comprising a fluid reservoir, a pump that is mounted on the reservoir, and a pushbutton that is mounted on the pump so as to actuate it. This design is entirely conventional and minimalist for a dispenser in the fields of perfumery, cosmetics, and pharmacy.

In the prior art, numerous dispensers are already known comprising a fluid applicator that is in direct communication with the fluid stored in the reservoir. The applicator may be secured to the reservoir, or, on the contrary, to a grip member that may be detached or separated from the reservoir. The applicator may be loaded with fluid by turning the dispenser upsidedown or by shaking it, or by suction, e.g. as in the document . . . .

In the prior art, conventional dispensers are also known with a reservoir, a pump that is mounted on the reservoir, and a pushbutton that is mounted on the pump so as to actuate it.

Those two types of dispensers (having an applicator and a pump) belong to clearly distinct families and to applications that are different.

An object of the present invention is to define a novel type of fluid dispenser having the basic characteristics of a conventional dispenser having a pump and pushbutton. Another object of the present invention is to combine, in a single dispenser, the advantages of the two types of dispenser (applicator and pump dispensers). Still another object of the present invention is to guarantee repetitive and controlled loading of a fluid applicator. Still another object of the present invention is to combine the operating characteristics of applicator dispensers and pump dispensers.

SUMMARY OF CERTAIN ASPECTS OF THE INVENTION

To achieve the various objects, the present invention proposes that the pushbutton comprises a base that is mounted in stationary manner on the pump, and a grip member that is mounted in removable manner on the base, the grip member including a fluid applicator, the grip member defining a bearing surface which may be pressed axially so as to move the base and thus actuate the pump so as to load the applicator with fluid. Compared to a conventional pump dispenser, the dispenser of the invention differs by the presence of the applicator that is secured to the pushbutton, which is itself incorporated in a grip member. Compared to a conventional applicator dispenser, the present invention differs by the presence of a pump for delivering the fluid to the applicator, and by the presence of a pushbutton on which the fluid applicator is mounted. With the dispenser of the present invention, the user combines the two methods of operating both types of dispenser, namely actuating a pushbutton so as to dispense a dose of fluid, and using the grip member that is detached from the remainder of the dispenser so as to be applied to an application surface such as the skin, the nails, the hair, etc.

According to an advantageous characteristic of the present invention, the base includes a reception dish for receiving the fluid applicator, the reception dish forming a feed orifice that is connected to the pump. The reception dish may be mounted directly on the actuator rod of the pump. Preferably, the dish fits closely to the shape of the applicator, and advantageously defines feed channels that extend radially outwards from the feed orifice. All of the dose dispensed by the pump is thus guaranteed to reach the fluid applicator, and to do so in controlled manner, as a result of the presence of the feed channels that extend in determined directions.

In another advantageous aspect of the invention, the grip member is mounted in sealed manner on the base, advantageously by flattening a gasket. Thus, the applicator is hermetically isolated inside its reception dish. Preferably, the grip member is connected in removable manner to the base by magnetic means. It is not necessary for the magnetic means to be situated on the base, but merely for the magnetic means to enable the grip member and the base to be connected together in removable manner. Magnetic means, as connection means, are particularly advantageous since they make it possible to put the grip member back on the base without having to exert any bearing force on the base. In this way, accidental or unintentional actuation of the pump is avoided. In addition, the magnetic means enable the grip member to be put back in a manner that is almost automatic and centered. Finally, as a result of the attraction force exerted, the magnetic means make it possible to flatten the gasket that enables the applicator to be hermetically isolated inside its reception dish.

According to another advantageous characteristic of the invention, the base slides, advantageously in sealed manner, in an axial guide bushing that is secured to the reservoir. In this way, it is guaranteed that no fluid leaks into the dispenser while it is sliding inside the guide bushing.

In another particularly advantageous aspect of the present invention, a fluid return passage connects the base to the reservoir. Thus, the fluid dispensed by the pump into the reception dish returns to the reservoir once the applicator is filled or saturated with fluid. By way of example, it is possible to envisage that a user presses more than once on the pushbutton so as to dispense a very large quantity of fluid. The excess fluid injected into the reception dish can thus be redirected towards the reservoir. In this way, it is guaranteed that the applicator is always filled or impregnated with the same quantity of fluid, and any risk of fluid leaks created by increased pressure inside the reception dish is avoided.

In an advantageous embodiment, the grip member comprises a grip body in which a pushbutton is movable downwards and upwards, the applicator being secured to move with the pushbutton that is advantageously urged into its rest position by a return spring that acts between the grip body and the pushbutton. Preferably, the applicator is connected to a mounting support that slides in sealed manner in the grip body, the pushbutton being in engagement with the mounting support. This is a particularly well developed embodiment, but it is also possible to imagine that the grip member as a whole constitutes a pushbutton on which the fluid applicator is mounted.

The spirit of the present invention resides in associating a fluid applicator with a pushbutton that serves to actuate a pump so as to load the applicator, the pushbutton forming part of a grip member that the user may grip so as to separate it from the remainder of the dispenser, and so as to put the applicator into contact with an application surface such as the skin.

BRIEF DESCRIPTION OF THE DRAWINGS

The invention is described below in greater detail with reference to the accompanying drawings that show two embodiments of the invention by way of non-limiting example.

In the figures:

FIGS. 3A and 3B show the grip member separate from the remainder of the dispenser, respectively in its rest position and in its actuated position; and FIG. 4 is a view similar to the view in FIG. 2 for a second embodiment of the invention.

DESCRIPTION OF CERTAIN PREFERRED EMBODIMENTS

Figure 1:
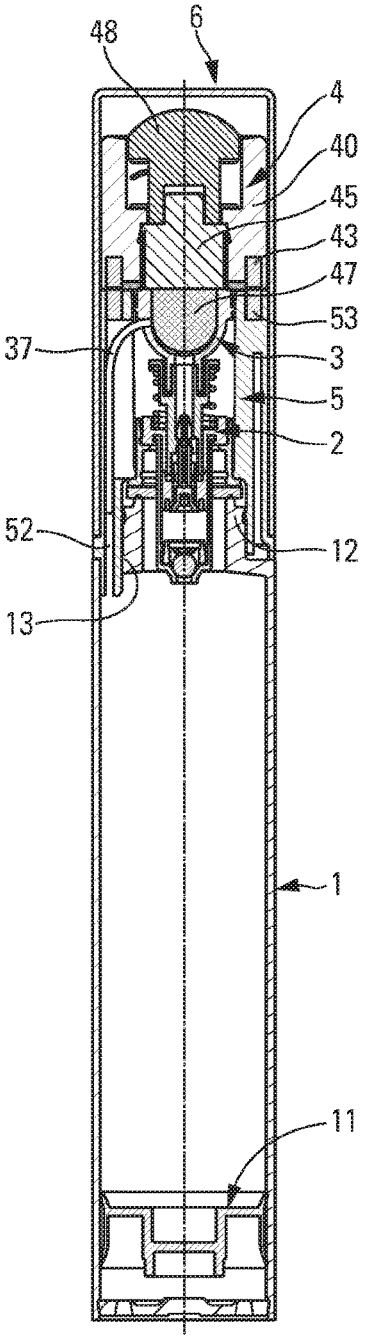
FIG. 1 is a vertical section view through a fluid dispenser in a first embodiment of the invention.
Figure 2:
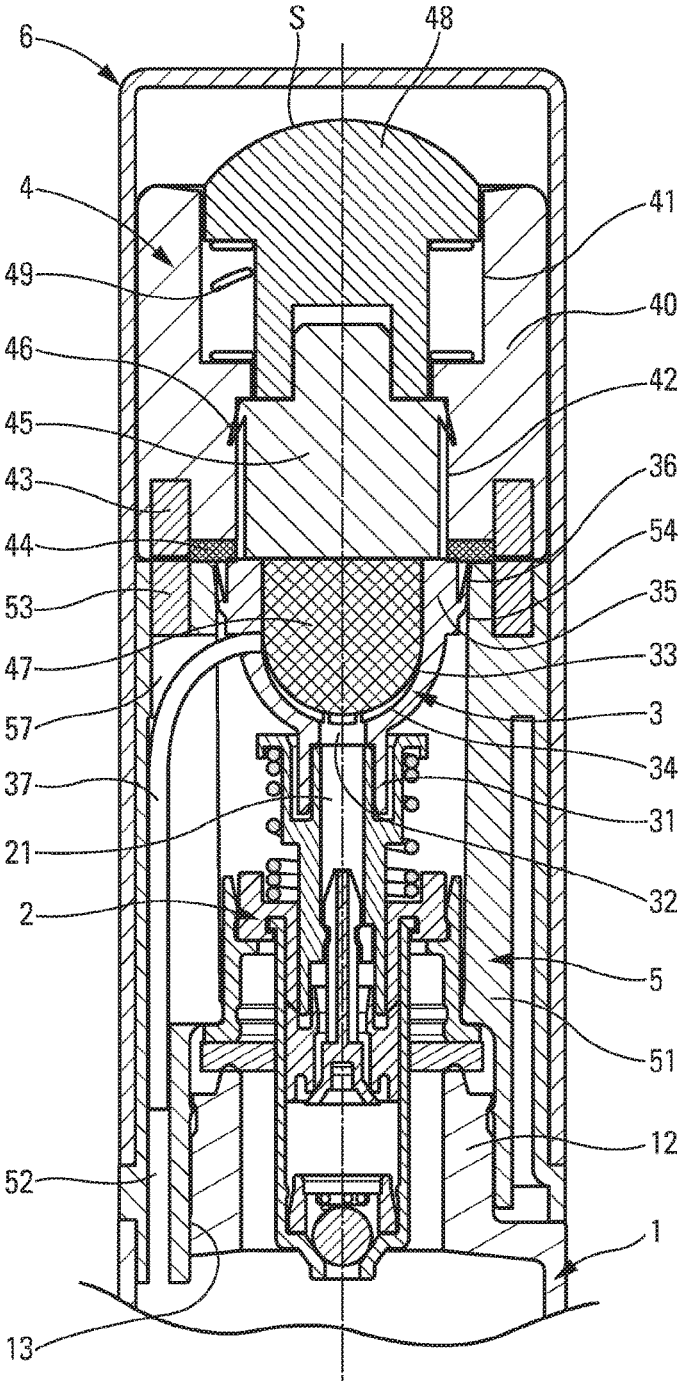
FIG. 2 shows the top portion of the FIG. 1 dispenser in greatly enlarged manner.

Reference is made initially to FIGS. 1 and 2 in order to describe in detail the structure of the fluid dispenser in the first embodiment of the invention. It can be seen that the dispenser presents an elongate configuration that resembles the shape of a pen or a felt-tip marker. Specifically, the fluid reservoir 1 is fine and long. In the non-limiting embodiment of FIGS. 1 and 2, the reservoir 1 includes a follower piston 11 for moving by sliding axially in sealed manner inside the reservoir, so as to decrease its working volume as the fluid is dispensed. In its start position, the follower piston 11 is arranged in the proximity of an end of the reservoir that is remote from a neck 12 on which a pump 2 is mounted. Given that the pump 2 is not an element that is critical to the present invention, it is not described in detail below. It may be of an entirely conventional type, with a pump body that defines an inlet with an inlet valve, a pump chamber, a piston, and an outlet valve that enables the fluid put under pressure in the pump chamber to be forced through a hollow actuator rod 21. In order to fasten the pump 2 on the neck 12, it is provided with a fastener ring in which it is securely held, which fastener ring is attached to the inside or the outside of the neck 12 in secure and sealed manner. This characteristic is entirely conventional for a pump and its fastening on a reservoir in the fields of perfumery, cosmetics, and pharmacy. However, it should be observed that the reservoir 1 defines a borehole 13 that passes through the wall thickness of the reservoir and that extends parallel to the side of the neck 12. The function of the borehole 13 is explained below.

In the invention, a base 3 is mounted on the pump 2 so as to collect the fluid dispensed by the pump. The base 3 includes a connection sleeve 31 that comes into engagement with the free end of the actuator rod 21 of the pump 2. The sleeve 31 is extended by a feed orifice 32 that opens out into the bottom of the reception dish 33 that may present the shape of an upsidedown dome. Starting from the feed orifice 32, the inside of the dish 33 forms a plurality of feed channels 34 that ideally extend outwards or in a star shape going away from the orifice 32. The channels 34 are in the form of grooves recessed into the inside wall of the cavity 33. The channels 34 extend up the inside wall of the dish 33 over a certain height, e.g. up to where the dish becomes cylindrical. The function of the feed channels 34 is to distribute, in substantially uniform or oriented manner, the fluid that is injected through the feed orifice 32 by the pump 2. It could also be said that the channels 34 make it possible to direct the fluid over the inside wall of the dish 33. At its top end, the dish 33 forms an annular collar 35 that is provided with a sealing lip 36 on its outside wall. At this point, it can thus be understood that moving the reception dish 3 downwards towards the pump 2 causes the actuator rod 21 to be depressed, and thus causes fluid to be dispensed through the rod 21, then through the feed orifice 32, and into the cavity 33 of the dish.

The dispenser also includes a guide bushing 5 of shape that is very generally cylindrical, that extends around the base 3 so as to define a base slide cylinder 54 in which there slides the sealing lip 36 formed by the collar 35 of the base 3. Thus, the base 3 is well guided axially while moving so as to actuate the pump 2. Furthermore, there is no risk of fluid leaking around the base 3 as a result of the sealed sliding of the lip 36 in the cylinder 54. In the embodiment presented to illustrate the present invention, the guide bushing 5 includes a section 51 that extends around the pump 2 so as to come into engagement around the neck 12 of the reservoir 1. In this way, complete stability of the bushing 5 on the reservoir 1 is guaranteed. At its top end, the axial guide bushing 5 includes one or more magnets 53, or a magnetized ring, extending around the base 3. Instead of the magnets 53, it is also possible to provide a ferromagnetic material. The function of the magnetized or ferromagnetic element is described below. In addition, the axial guide bushing 5 also forms a cannula 52 having an end that is engaged through the borehole 13 of the reservoir 1. In addition, a duct 37, preferably a flexible hose, connects the dish 33 to the cannula 52. By way of example, the hose 37 may open out into the dish 33 just above the top end of the feed channels 34. The flexibility of the hose 37 is explained by the fact that the base 3 is axially movable over a certain stroke, while the cannula 52 is stationary, since it is mounted on the reservoir 1. The hose 37 and the cannula 52 co-operate with each other to define a fluid return passage that connects the base 3 directly to the fluid reservoir 1. By way of example, the hose 37 may pass through a perforated portion 57 of the axial guide bushing 5.

The dispenser of the invention also includes a grip member 4 that is mounted both on the base 3 and on the axial guide bushing 5. In this embodiment, the grip member 4 includes a grip body 40 that defines an upper housing 41 and a lower slide cylinder 42. The housing 41 communicates directly with the cylinder 42, such that the inside of the grip body 40 is hollow. At its bottom end, the grip body 40 includes one or more magnets 43, or a magnetized ring, extending around the slide cylinder 42. Instead of magnets, it is also possible to provide a ferromagnetic material. With reference to FIG. 2, it can be seen that the magnets 43 of the grip body 40 are situated immediately facing the magnets 53 that are mounted on the bushing 5. Thus, as a result of magnetic attraction, the grip member 40 is connected in removable manner onto the reception base 3 and the axial guide bushing 5. In order to guarantee sealing at the base 3 and the bushing 5, a gasket 44 is provided that surrounds the slide cylinder 42 and that comes to be flattened on the bushing 5 and/or the base 3. The gasket 44 may be secured to the grip member 40, the bushing 5, or the base 3. The magnetic connection means formed by the magnets 43 and 53 not only enable the grip member 4 to be repositioned automatically, but they also enable the gasket 44 to be flattened, and above all they make it possible to avoid actuating the pump 2 unintentionally. Specifically, it suffices to place the grip member 4 on the base 3 without exerting any bearing force towards the pump 2.

The grip member 4 also includes a mounting support 45 that is provided with a sealing lip 46 that is adapted to slide in sealed manner in the slide cylinder 42 of the grip body 40. A fluid applicator 47 is connected to the mounting support 45 in such a manner as to project downwards into the dish 33, as shown very clearly in FIG. 2. It should be observed that the applicator 47 fits closely to the inside surface of the dish 33, or vice versa: only the feed channels 34 are not closed by the applicator 47. It is possible to use any appropriate material to make the applicator 47, e.g. a porous material, foam, felt, sintered material, etc. At its top end, the mounting support 45 is connected in secure manner to a pushbutton 48 that is received in the housing 41. The pushbutton 48 defines a bearing surface S. A return spring 49, that bears at its bottom end against the mounting body 40, urges the pushbutton 48 into its rest position in which it projects out from the housing 41.

Optionally, the dispenser may also include a protective cap 6 that covers the grip member 4 and the axial guide bushing 5.

In its rest position, the grip member 4 is as shown in FIG. 3A. The mounting support 45 is urged into abutment against a shoulder that is formed by the grip body 40. Only the applicator 47 projects downwards from the gasket 44, which is itself surrounded by the magnets 43. In this rest position, the applicator 47 is housed in the reception base 3 without exerting any considerable downward axial force. The pump 2 is at rest, its actuator rod 21 being extended as much as possible. The magnets 43, 53 are also as close together as possible, so as to hold the grip member 4 firmly, but nevertheless in removable manner, on the base 3 and the bushing 5.

Starting from this rest position, the user may press axially downwards on the pushbutton 48 against the return spring 49, so as to move the mounting support 45 and the applicator 47 downwards. The base 3 is forced to move downwards with the actuator rod 21 of the pump 2. As a result, a dose of fluid is dispensed through the actuator rod 21, then through the feed orifice 32 and the feed channels 34 into the dish 33 in which the applicator 47 is situated. Said applicator is impregnated and loaded with fluid. Advantageously, it is possible to design the applicator 47 or the pump 2 in such a manner that a single actuation of the pump suffices to fill the applicator 47. When the user actuates the pushbutton 48 more than once, the excess fluid injected into the dish 33 is returned to the reservoir 1 through the hose 37 and the cannula 52. After actuating the pushbutton 48, the user grips the grip member 4 via its grip body 40 and separates it from the bushing 5 and from the dish 3, overcoming the magnetic attraction force exerted by the magnets 43, 53. The applicator 47 is thus in the open air and may be put into contact with a dedicated application surface, such as the skin, the nails, the hair, etc. Once application has terminated, the user merely places the grip member 4 on the base 3 and the bushing 5 without exerting any pressure, with the magnetic connection means ensuring on their own that the grip member 4 is held in place.

The depressed position of the pushbutton 48 is shown in FIG. 3B. It can be seen that the spring 49 is greatly compressed and that the mounting support 45 now projects downwards below the gasket 44.

Reference is made below to FIG. 4 which shows a second embodiment of the invention. The main difference compared with the first embodiment is that there is no grip body in which a pushbutton, a mounting support, and the applicator slide. In this more minimalist second embodiment, the fluid applicator 47 is mounted in a mounting support 45' that is fitted, in secure manner, directly in a mounting body 40' that defines a bearing surface S. The grip body 40' also includes one or more magnets 43, or a magnetized ring, arranged around the mounting support 45'. Instead of the magnets 43, it is also possible to provide a ferromagnetic material. In addition, it should be observed that, on its collar 35' (that forms the slide lip 36), the base 3' includes one or more magnets 38 or a magnetized ring, and a gasket 39. As in the first embodiment, as a result of their mutual magnetic attraction, the magnets 43, 38 make it possible to compress the gasket 39 and ensure sealing between the grip member 4' and the base 3'. It should be observed that the sealing lip 36 of the base 3' slides inside a slide cylinder 54 that is formed by an axial guide bushing 5'.

In this second embodiment, the entire grip member 4' is moved axially so as to move the base 3' with it, and thus actuate the pump 2. Although not shown, the dish 33 may also be provided with a fluid return passage for returning fluid to the reservoir, as in the first embodiment. Once the applicator 47 is filled with fluid, the user separates the grip member 4' from the base 3' and may put the applicator 47 into contact with an appropriate application surface.

The grip member 4' is a single-piece element, unlike the grip member 4 of the first embodiment in which the pushbutton 4, the mounting support 45, and the fluid applicator 47 are movable relative to the grip body 40.

The invention thus provides a pump and applicator dispenser having a pushbutton serving to actuate the pump that is provided with the fluid applicator.

The invention claimed is:

1. A fluid dispenser comprising a fluid reservoir, a pump that is mounted on the fluid reservoir, and a pushbutton that is mounted on the pump so as to actuate the pump;

wherein the pushbutton comprises a base that is mounted in stationary manner on the pump, and a grip member that is mounted in removable manner on the base, the grip member including a fluid applicator, the grip member defining a bearing surface configured to be pressed axially so as to move the base and thus actuate the pump so as to load the applicator with fluid; and wherein the grip member is mounted in sealed manner on the base by flattening a gasket.

2. The dispenser according to claim 1, wherein the base includes a reception dish for receiving the fluid applicator, the reception dish forming a feed orifice that is connected to the pump.

3. The dispenser according to claim 2, wherein the reception dish fits closely to the shape of the fluid applicator, and defines feed channels that extend radially from the feed orifice.

4. The dispenser according to claim 1, wherein the grip member is connected in removable manner to the base by magnetic means.

5. The dispenser according to claim 1, wherein the base slides in sealed manner in an axial guide bushing that is secured to the reservoir.

6. The dispenser according to claim 1, wherein a fluid return passage connects the base to the reservoir.

7. The dispenser according to claim 1, wherein the grip member comprises a grip body in which the pushbutton is movable downwards and upwards, the applicator being secured to move with the pushbutton that is urged into a rest position of the pushbutton by a return spring that acts between the grip body and the pushbutton.

8. The dispenser according to claim 7, wherein the applicator is connected to a mounting support that slides in sealed manner in the grip body, the pushbutton being in engagement with the mounting support.

9. A fluid dispenser comprising a fluid reservoir, a pump mounted on the fluid reservoir, and a pushbutton that is mounted on the pump so as to actuate the pump;

wherein the pushbutton comprises a base mounted in stationary manner on the pump, and a grip member mounted in removable manner on the base, the grip member including a fluid applicator, the grip member defining a bearing surface configured to be pressed axially so as to move the base and thus actuate the pump so as to load the applicator with fluid; and wherein the base slides in sealed manner in an axial guide bushing that is secured to the reservoir.

10. The dispenser according to claim 9, wherein the base includes a reception dish for receiving the fluid applicator, the reception dish forming a feed orifice that is connected to the pump.

11. The dispenser according to claim 10, wherein the reception dish fits closely to the shape of the fluid applicator, and defines feed channels that extend radially from the feed orifice.

12. The dispenser according to claim 9, wherein the grip member is mounted in sealed manner on the base by flattening a gasket.

13. The dispenser according to claim 9, wherein the grip member is connected in removable manner to the base by magnetic means.

14. The dispenser according to claim 9, wherein a fluid return passage connects the base to the reservoir.

15. The dispenser according to claim 9, wherein the grip member comprises a grip body in which the pushbutton is movable downwards and upwards, the applicator being secured to move with the pushbutton that is urged into a rest position of the pushbutton by a return spring that acts between the grip body and the pushbutton.

16. The dispenser according to claim 15, wherein the applicator is connected to a mounting support that slides in sealed manner in the grip body, the pushbutton being in engagement with the mounting support.

17. A fluid dispenser comprising a fluid reservoir, a pump mounted on the fluid reservoir, and a pushbutton that is mounted on the pump so as to actuate the pump;

wherein the pushbutton comprises a base mounted in stationary manner on the pump, and a grip member mounted in removable manner on the base, the grip member including a fluid applicator, the grip member defining a bearing surface configured to be pressed axially so as to move the base and thus actuate the pump so as to load the applicator with fluid; and wherein a fluid return passage connects the base to the reservoir.

18. The dispenser according to claim 17, wherein the base includes a reception dish for receiving the fluid applicator, the reception dish forming a feed orifice that is connected to the pump.

19. The dispenser according to claim 18, wherein the reception dish fits closely to the shape of the fluid applicator, and defines feed channels that extend radially from the feed orifice.

20. The dispenser according to claim 17, wherein the grip member is mounted in sealed manner on the base by flattening a gasket.

21. The dispenser according to claim 17, wherein the grip member is connected in removable manner to the base by magnetic means.

22. The dispenser according to claim 17, wherein the base slides in sealed manner in an axial guide bushing that is secured to the reservoir.

23. The dispenser according to claim 17, wherein the grip member comprises a grip body in which the pushbutton is movable downwards and upwards, the applicator being secured to move with the pushbutton that is urged into a rest position of the pushbutton by a return spring that acts between the grip body and the pushbutton.

24. The dispenser according to claim 23, wherein the applicator is connected to a mounting support that slides in sealed manner in the grip body, the pushbutton being in engagement with the mounting support.

25. A fluid dispenser comprising a fluid reservoir, a pump mounted on the fluid reservoir, and a pushbutton that is mounted on the pump so as to actuate the pump;

wherein the pushbutton comprises a base mounted in stationary manner on the pump, and a grip member mounted in removable manner on the base, the grip member including a fluid applicator, the grip member defining a bearing surface configured to be pressed axially so as to move the base and thus actuate the pump so as to load the applicator with fluid; and wherein the grip member comprises a grip body in which the pushbutton is movable downwards and upwards, the applicator being secured to move with the pushbutton that is urged into a rest position of the pushbutton by a return spring that acts between the grip body and the pushbutton.

26. The dispenser according to claim 25, wherein the base includes a reception dish for receiving the fluid applicator, the reception dish forming a feed orifice that is connected to the pump.

27. The dispenser according to claim 26, wherein the reception dish fits closely to the shape of the fluid applicator, and defines feed channels that extend radially from the feed orifice.

28. The dispenser according to claim 25, wherein the grip member is mounted in sealed manner on the base by flattening a gasket.

29. The dispenser according to claim 25, wherein the grip member is connected in removable manner to the base by magnetic means.

30. The dispenser according to claim 25, wherein the base slides in sealed manner in an axial guide bushing that is secured to the reservoir.

31. The dispenser according to claim 25, wherein a fluid return passage connects the base to the reservoir.

32. The dispenser according to claim 25, wherein the applicator is connected to a mounting support that slides in sealed manner in the grip body, the pushbutton being in engagement with the mounting support.

* * * * *